United States Patent [19]

Pezzoli

[11] Patent Number: 4,638,839

[45] Date of Patent: Jan. 27, 1987

[54] GUIDE FOR THE GRIPPER CARRYING STRAPS INSIDE THE SHED OF WEAVING LOOMS

[75] Inventor: Nello Pezzoli, Leffe, Italy

[73] Assignee: Vamatex S.p.A., Villa Di Serio, Italy

[21] Appl. No.: 668,873

[22] Filed: Oct. 10, 1984

[30] Foreign Application Priority Data

Oct. 10, 1983 [IT] Italy ..... 23232 A/83

[51] Int. Cl.[4] ..... D03D 47/00

[52] U.S. Cl. ..... 139/449; 139/188 R

[58] Field of Search ..... 139/429, 440, 442, 443, 139/444, 445, 446, 447, 449, 188 R, 191, 435

[56] References Cited

U.S. PATENT DOCUMENTS

| | | | |
|---|---|---|---|
| 2,316,703 | 4/1943 | Moessinger | 139/188 R |
| 3,299,911 | 1/1967 | Dewas | 139/449 |
| 4,391,305 | 7/1983 | Takahashi | 139/435 |

*Primary Examiner*—Henry S. Jaudon

*Attorney, Agent, or Firm*—Young & Thompson

[57] ABSTRACT

A guide for the gripper carrying straps inside the shed of weaving looms is formed as a nonsymmetrically shaped plate, the upper side of which is broken off to form two lateral slanting beaks delimiting the seat for the strap, the beak close to the reed being higher than the other. The seat has equal opposed ends of semicircular or wedge shape and a central undercut area on its side opposite to the beaks.

1 Claim, 3 Drawing Figures

GUIDE FOR THE GRIPPER CARRYING STRAPS INSIDE THE SHED OF WEAVING LOOMS

BACKGROUND OF THE INVENTION

It is known that in weaving looms with grippers, wherein the gripper carrying straps are positively guided inside the shed, the contrasting requirements arise of an efficient guiding of the straps and of an efficient protection of the warp yarns from impacts and from engagements with the strap guiding means, which may lead to wear and/or breakage of said yarns.

SUMMARY OF THE INVENTION

The present invention concerns improvements in the guides for the gripper carrying straps inside the shed.

The guide according to the invention is characterized by being made in the form of a nonsymmetrical by shaped plate, the upper side of which is broken off to form two lateral slanting beaks delimiting the seat for the strap, the beak close to the reed being higher than the other, and by the fact that the opposed ends of said seat are of equal semicircular or wedge shape, while the side of said seat opposite to the beaks has a central undercut area.

BRIEF DESCRIPTION OF THE DRAWINGS

The invention will now be described, by mere way of example, with reference to the accompanying drawing, in which.

DESCRIPTION OF THE PREFERRED EMBODIMENTS

Figure 1:
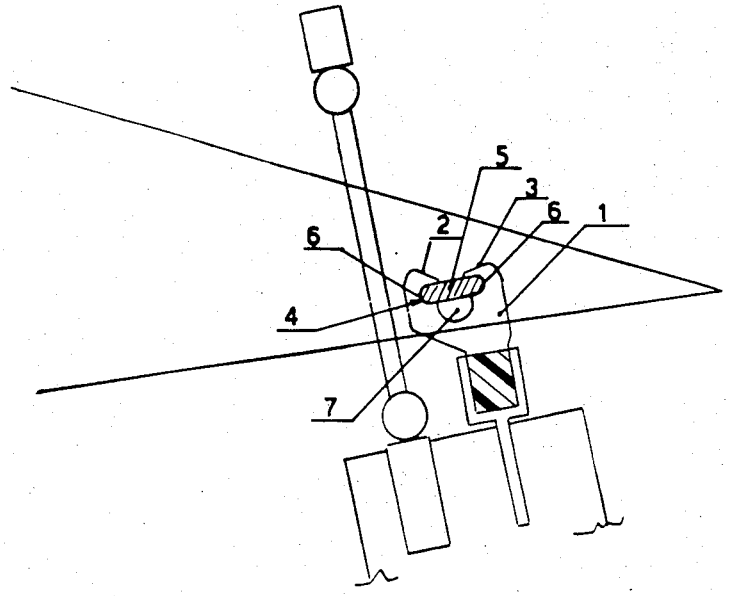
FIG. 1 is a side view of the guide according to the invention, mounted on a weaving loom shown only in parts.

As shown in the drawing, the hook 1 according to the invention is formed as a nonsymmetrical by shaped metal plate, the upper side of which is broken off to form two opposed lateral slanting beaks 2 and 3, delimiting at the top the seat 4 for the strap 5. Said seat 4 for the strap has opposed ends 6 of semicircular shape (FIG. 1) and an inner central undercut area 7.

The strap 5 is in turn shaped so as to mate exactly with the shape of the seat 4, especially in correspondence of its sides.

Figure 2:
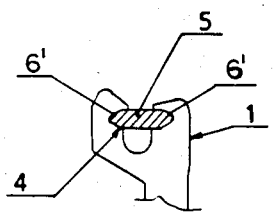
FIG. 2 shows a modified embodiment of the guide of FIG. 1.

In the embodiment of FIG. 2, the opposed ends 6' of the seat 4 are wedge-shaped, instead of having a semicircular shape, with substantially equal results.

The shape of the opposed ends of the seat 4 of the plate forming the hook 1 could actually also be different from those heretofore described and illustrated, provided that it corresponds to a configuration such as to prevent any possible access of the warp yarns between said seat 4 and the strap 5, as perfectly accomplished by the circular and wedge shapes. To obtain this, the shape of the seat 4—into which slides the strap 5—should not be parallel to the plane of said strap but should form a certain angle with the plane of the strap.

With an arrangement of this type, thanks to the reduced dimensions and to the special shape of the hook seat 4 and of the strap 5 (provided to mate exactly with the shape of said seat), it is practically impossible for a warp yarn, contacting the strap, to be dragged inside the hook and cut off, as frequently happens with the conventional arrangements.

In fact, with the arrangement according to the invention, the hook guiding surfaces engaged by the strap have lower edges disposed at, a certain angle with the plane of the strap itself, such as to prevent any insertion of warp yarns between the hook and the strap, on account of the different inclination of the exposed surfaces of said hook and strap in the region where they come into mutual contact.

Futhermore, the fact that both sides of the gripper carrying straps are guided into a single guide prevents—far more than with the known arrangements—the insertion of warp yarns under the hook beak 2, which is higher and closer to the reed, the arc which said yarns are apt to describe between the two beaks being of smaller width.

As to the possibility of the warp yarn penetrating into the guide from the top, by crossing it, this is prevented by making—as seen—the beak 2 closer to the reed to project upward more than the opposite beak 3.

The present invention also concerns a unit for guiding the gripper carrying straps inside the shed of weaving looms, said unit comprising a plurality of hooks of the type described heretofore, mounted on the sley of the loom.

Figure 3:
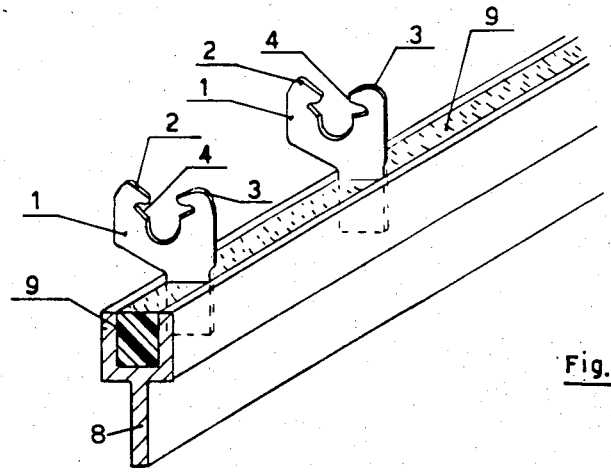
FIG. 3 is an axonometric view of the mounting system of a plurality of hooks like that of FIG. 1, to obtain a unit for guiding the gripper carrying straps in a weaving loom.

Said unit is obtained—very conveniently—by inserting, at an even mutual distance, a plurality of hooks 1 into an extrusion 8 (FIG. 3) fixedly connected to the loom sley or forming part thereof, and by fixing the hooks into the extrusion 8 by casting therein of a resin 9.

It is understood that there may be other embodiments of the invention falling within the scope of the invention itself.

I claim:

1. In a weaving loom having a reed, flat horizontal gripper-carrying straps mounted for reciprocal movement inside the shed of the loom, and a plurality of supports of said straps mounted adjacent said reed, each said support comprising an upright plate having two lateral beaks delimiting a seat for the strap, the seat including a portion below the strap having a central undercut area so as to support only the edges of said strap; the improvement comprising the beak closer to the reed being higher than the other beak, and in which the seat portion and the supported strap edges are downwardly inclined toward said central undercut area.

* * * * *